US010388160B2

(12) United States Patent
Auracher et al.

(10) Patent No.: US 10,388,160 B2
(45) Date of Patent: Aug. 20, 2019

(54) CONCEPT FOR WARNING AT LEAST ONE ROAD USER LOCATED WITHIN A PARKING FACILITY

(71) Applicant: Robert Bosch GmbH, Stuttgart (DE)

(72) Inventors: Juergen Auracher, Oberstenfeld (DE); Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/867,229

(22) Filed: Jan. 10, 2018

(65) Prior Publication Data

US 2018/0204452 A1 Jul. 19, 2018

(30) Foreign Application Priority Data

Jan. 18, 2017 (DE) ..... 10 2017 200 727

(51) Int. Cl.

| | |
|---|---|
| ***G08G 1/0967*** | (2006.01) |
| ***G08G 1/0969*** | (2006.01) |
| ***G08G 1/16*** | (2006.01) |
| ***G08G 1/005*** | (2006.01) |
| ***G08G 1/04*** | (2006.01) |
| ***G08G 1/095*** | (2006.01) |
| *G06Q 50/26* | (2012.01) |

(52) U.S. Cl.

CPC ..... *G08G 1/0967* (2013.01); *G08G 1/005* (2013.01); *G08G 1/04* (2013.01); *G08G 1/095* (2013.01); *G08G 1/0969* (2013.01); *G08G 1/16* (2013.01); *G08G 1/164* (2013.01); *G06Q 50/265* (2013.01)

(58) Field of Classification Search

CPC ..... G08G 1/0967; G08G 1/005; G08G 1/04; G08G 1/095; G08G 1/0969; G08G 1/16; G08G 1/164

See application file for complete search history.

(56) References Cited

U.S. PATENT DOCUMENTS

| | | | | |
|---|---|---|---|---|
| 9,248,834 | B1 | 2/2016 | Ferguson et al. | |
| 2010/0156672 | A1 | 6/2010 | Yoo et al. | |
| 2014/0046506 | A1* | 2/2014 | Reichel | B62D 15/0285 701/2 |
| 2017/0351267 | A1* | 12/2017 | Mielenz | B60W 30/06 |

FOREIGN PATENT DOCUMENTS

| | | | |
|---|---|---|---|
| DE | 102008036009 | A1 | 10/2009 |
| DE | 102012021282 | A1 | 4/2014 |
| DE | 102014211557 | A1 | 12/2015 |
| EP | 1775692 | A2 | 4/2007 |
| JP | 2012155522 | A | 8/2012 |

* cited by examiner

*Primary Examiner* — Leon Flores
(74) *Attorney, Agent, or Firm* — Norton Rose Fulbright US LLP; Gerard Messina

(57) ABSTRACT

A method, of a system of a parking facility, for warning at least one road user located within the parking facility includes: monitoring the parking facility using a monitoring system of the parking facility, ascertaining, based on the monitoring, whether the road user is to be warned of a hazard present within the parking facility, and warning the road user if the ascertainment has indicated that the road user is to be warned of a hazard.

18 Claims, 3 Drawing Sheets

CONCEPT FOR WARNING AT LEAST ONE ROAD USER LOCATED WITHIN A PARKING FACILITY

CROSS-REFERENCE TO RELATED APPLICATIONS

The present application claims priority under 35 U.S.C. § 119 to DE 10 2017 200 727.3, filed in the Federal Republic of Germany on Jan. 18, 2017, the content of which is hereby incorporated by reference herein in its entirety.

FIELD OF THE INVENTION

The present invention relates to a method for warning at least one road user located within a parking facility that includes a monitoring system. The present invention further relates to a system for warning a road user located within a parking facility. The present invention also relates to a parking facility. The present invention further relates to a computer program.

BACKGROUND

The unexamined patent application DE 10 2014 211 557 A1 shows a valet parking system for automatically bringing a vehicle to a parking space within a predefined parking area. U.S. Pat. App. Pub. No. 2010/0156672 shows a system and a method for automatically parking a vehicle. U.S. Pat. No. 9,248,834 shows a concept for predicting trajectories of objects.

SUMMARY

An object of the present invention is to provide for efficiently warning at least one road user located within a parking facility.

According to an example embodiment of one aspect of the present invention, a method for warning at least one road user within a parking facility includes: monitoring the parking facility with the aid of a monitoring system of the parking facility; ascertaining, based on the monitoring, whether the road user is to be warned of a hazard present within the parking facility; and warning the road user if the ascertainment has indicated that the road user is to be warned of a hazard.

According to an example embodiment of another aspect of the present invention, a system for warning at least one road user located within a parking facility includes: a monitoring system for monitoring the parking facility; a processing unit for ascertaining, based on the monitoring, whether the road user is to be warned of a hazard present within the parking facility; and a warning system for warning the road user if the ascertainment has indicated that the road user is to be warned of a hazard.

According to an example embodiment of another aspect of the present invention, a parking facility includes the above-described system.

According to an example embodiment of another aspect of the present invention, a computer program includes program code for carrying out the above-described method when the computer program is executed on a computer.

According to example embodiments, the parking facility is monitored using a monitoring system assigned to, e.g., that is part of, the parking facility. Thus, the monitoring system is, in particular, part of its infrastructure.

Based on the monitoring, it is then ascertained whether a road user located within the parking facility is to be warned of a hazard. The road user is warned if the ascertainment has indicated that the road user must be warned of a hazard. Otherwise, no warning is given.

In this way, hazardous situations for the road user can therefore be avoided, or a probability of a hazardous situation for the road user can be reduced. This yields, in particular, a technical advantage that the safety of the road user can be efficiently enhanced.

Because the road user is warned only if the ascertainment has indicated that the road user is to be warned of a hazard, it is possible, for example, to advantageously avoid unnecessary alerting the road user. Not every hazard present within a parking facility is automatically a hazard for the road user. If, for example, the hazard is located on the top level of a parking facility designed as a parking garage, with the road user being located on the lowest level of the parking facility, then the road user is, in general, not faced with any immediate threat by the hazard on the top level. To warn of the hazard on the top level out of hand in such a case could unnecessarily frighten the road user, so that the user could panic, for example, which, in turn, could then result, for example, in an unsafe situation for the road user.

Thus, this yields a technical advantage that an efficient concept is provided for efficiently warning at least one road user located within a parking facility.

A parking facility within the context of the description is a parking facility for motor vehicles.

The wording "at least one road user" includes both exactly one road user as well as multiple road users. This means, therefore, in particular, that the plural of road user is always to be implied as an example, if road user is used in the singular, and vice versa.

According to an example embodiment, the hazard is an automatically guided motor vehicle moving, i.e., traveling, within the parking facility.

An automatically guided motor vehicle refers, for example, to a remote-controlled motor vehicle.

An automatically guided motor vehicle refers, for example, to an autonomously driving motor vehicle.

Thus, an automatically guided motor vehicle travels without a human driver, and thus travels driverless or unmanned.

A driver can still be situated in the motor vehicle, but in the case of an automatically guided motor vehicle, the driver does not drive the motor vehicle. However, the automatically guided motor vehicle can also be free of a driver or vehicle occupants, for example. Thus, this means, for example, that persons are no longer situated inside the automatically driven motor vehicle.

According to an example embodiment the warning includes the provision of an instruction to act, which indicates how the road user is to act in order to reduce a threat to him/herself as a result of the hazard.

This yields, for example, a technical advantage that the threat as a result of the hazard to the road user can be efficiently reduced.

An instruction to act includes, for example, an instruction that the road user is to stop.

An instruction to act includes, for example, an instruction in which direction the road user is to move.

According to an example embodiment, the ascertainment includes a prediction of a movement of the road user and an ascertainment of whether the predicted movement collides with a hazard zone of the hazard, the road user being warned if the predicted movement is ascertained to be predicted to collide with the hazard zone.

This yields, in particular, a technical advantage that the ascertainment of whether the road user is to be warned of a hazard present within the parking facility can be efficiently carried out. Based on the prediction of the movement of the road user, it can be estimated at least with a certain probability whether the road user will move into the hazard zone of the hazard. In this case, it is then provided that the road user is warned of the hazard.

Thus, if, for example, the road user moves away from the hazard, which has been ascertained based on the prediction, then no warning of the hazard is given to the road user, for example.

A hazard zone denotes, in particular, an area around the hazard, into which no road user can move for reasons of safety. Thus, a hazard zone refers, in particular, to a safety distance from the hazard. Thus, if according to the predicted movement, the road user comes closer to the hazard than the safety distance, the road user is then warned.

According to an example embodiment, a position of the road user is determined, the ascertainment being carried out on the basis of the position of the road user.

This yields, in particular, a technical advantage that the ascertainment of whether the road user is to be warned of a hazard present within the parking facility can be efficiently carried out.

The determination of the position of the road user is carried out, for example, with the use of the monitoring system.

It is provided, for example, that the determination of a position of the road user is carried out using a mobile terminal carried by the road user. The determination of the position of a mobile terminal on the basis, for example, of GPS, WLAN, Bluetooth, and/or mobile telephony is known per se and therefore requires no further explanation at this point. Thus, it is provided, for example, that position data of a mobile terminal carried by the road user are received via a wireless communication network, the position data indicating a position of the mobile terminal.

The position of the mobile terminal is determined, for example with the use of received position data, which have been transmitted from the mobile terminal via a wireless communication network. This means, therefore, that the mobile terminal itself determines its position, for example, and transmits this position as position data via a wireless communication network.

If the position of the mobile terminal is known, it is also possible to determine the position of the road user via the mobile terminal.

In another example embodiment, if the hazard is an automatically guided motor vehicle, a position of the motor vehicle is determined, the ascertainment being carried out based on the position of the motor vehicle.

This yields, for example, a technical advantage that the ascertainment of whether the road user is to be warned of a hazard present within the parking facility can be efficiently carried out.

The position of the motor vehicle is determined, for example, using the monitoring system.

The position of the motor vehicle is determined, for example, using received position data, which have been transmitted by the motor vehicle via a wireless communication network. This means, therefore, that the motor vehicle itself determines its position, for example, and transmits this position as position data via a wireless communication network.

According to an example embodiment, if the hazard is an automatically guided motor vehicle, the ascertainment includes a prediction of a movement of the motor vehicle and an ascertainment of whether the predicted movement collides with the road user, the road user being warned if the predicted movement collides with the road user.

This yields, for example, a technical advantage that the ascertainment of whether the road user is to be warned of a hazard present within the parking facility can be efficiently carried out.

Thus, on the basis of the prediction, it is known with a predetermined probability to where the motor vehicle will move and whether, for example, it will then collide with the road user.

If, therefore, the motor vehicle moves away from the road user, as predicted, no warning is given to the road user, for example.

In an example embodiment, if the hazard is an automatically guided motor vehicle, it is ascertained which driving task the motor vehicle is instantaneously carrying out, the ascertainment of whether the road user is to be warned being carried out on the basis of the instantaneous driving task of the motor vehicle.

This yields, for example, a technical advantage that the ascertainment of whether the road user must be warned can be efficiently carried out.

A threat, which may originate from the motor vehicle, is greater or lesser as a function of the driving task. Thus, for example, a motor vehicle which is about to automatically park is generally no longer a hazard for road users once it has parked. Thus, the threat originating from this motor vehicle is of very limited duration, as compared, in particular, to a motor vehicle, which is at the moment automatically unparking and is therefore subsequently automatically guided within the parking facility.

According to an example embodiment, it is provided that the warning includes a sending of a message via a wireless communication network to a mobile terminal carried by the road user.

This yields, for example, a technical advantage that the road user can be efficiently warned.

Thus, a message within the context of the description includes, in particular, a warning of the hazard and/or an instruction to act, which indicates how the road user is to behave.

A mobile terminal within the context of the description is a cellular phone, for example.

A wireless communication network within the context of the description includes, for example, a WLAN communication network and/or a mobile radio communication network, for example, an LTE communication network and/or a GSM communication network.

According to an example embodiment, if the road user is a motor vehicle, the warning includes a sending of a message via a wireless communication network to a main control unit of the motor vehicle.

This yields, for example, a technical advantage that the motor vehicle can be efficiently warned.

Thus, the message includes, in particular, a warning of the hazard and/or an instruction to act, which indicates how the road user is to behave in order to reduce a threat to itself by the hazard.

A road user within the context of the description, for example, is one of the following road users: a person, a cyclist, a motor vehicle, a driver of a motor vehicle, a pedestrian.

In an example embodiment, the warning includes a warning with the aid of a display device situated within the parking facility.

This yields, for example, an advantage that the road user can be efficiently warned.

According to an example embodiment, multiple display devices, which are identically or differently designed, for example, are provided. A display device includes, for example, a video projector, a screen and/or a symbol display.

In a normal situation, for example, i.e., if no warning of a hazard must be given, a display device can be used to display advertising, for example. Thus, such a display device is used only situationally, i.e., only if a road user must be warned of a hazard.

According to an example embodiment, the warning includes a visual provision of a real image of the hazard and/or of an abstract image of the hazard.

This yields, for example, a technical advantage that the road user can be efficiently visually warned.

According to an example embodiment, one or multiple display devices are situated within the parking facility. The visual provision of a real image of the hazard or of the abstract image of the hazard is carried out using one or more display devices situated within the parking facility.

According to an example embodiment, the warning includes a visual provision of a digital map of a partial area or of an entire area of the parking facility, in which the hazard and the road user are located, the hazard and the road user being represented in the digital map.

This yields, for example, a technical advantage that the road user can be efficiently warned. In this way, the road user can, in particular, be efficiently provided with the information where the hazard is located and where the road user is located relative to the hazard within the parking facility.

The visual provision of the digital map is carried out, for example, using one or more display devices situated within the parking facility.

According to an example embodiment, in addition to the hazard and to the road user, a respective movement direction of the hazard and/or the road user is also indicated in the digital map. This yields, for example, a technical advantage that the road user can be efficiently warned.

In an example embodiment, an instruction for the road user to act is indicated in the digital map. For example, a directional instruction for the road user, for example, in which direction the road user is to move in order to reduce a threat to itself by the hazard, is indicated in the digital map.

In an example embodiment, the warning includes a provision of a real image from a perspective of the road user. This yields, in particular, a technical advantage that the road user can be efficiently warned. The provision of a real image from a perspective of the road user is carried out, for example, using one or more display devices situated within the parking facility.

According to an example embodiment, the system includes one or more display devices.

According to one specific embodiment, the warning system includes one or more signal generators. A signal generator, for example, is a visual signal generator, an acoustic signal generator, or a haptic signal generator. In the case of multiple signal generators, these are identically designed, for example, or are differently designed, for example.

According to an example embodiment, the monitoring system includes one or more surroundings sensors. In the case of multiple surroundings sensors, they can be identically or differently designed from each other.

A surroundings sensor, for example, is one of the following surroundings sensors: a radar sensor, an ultrasonic sensor, a video sensor, in particular, a video sensor of a video camera, a laser sensor, a LIDAR sensor, a magnetic sensor, a photoelectric barrier sensor, and/or a pressure sensor, for example, a piezoelectric pressure sensor.

A surroundings sensor is situated, for example, on an infrastructure element of the parking facility. An infrastructure element, for example, is a wall, a column, a floor, a ceiling, a door, or a doorway arch.

The pressure sensor is situated, for example, on a floor or countersunk in a floor.

A pressure sensor is situated, for example, inside a tube, which is situated, for example, on the floor of the parking facility or countersunk in the floor of the parking facility.

A floor of the parking facility, for example, is part of a driving area of the parking facility.

According to an example embodiment, it is provided that the surroundings sensor or surroundings sensors is/are situated spatially distributed within the parking facility.

According to an example embodiment, the system for warning at least one road user located within a parking facility is designed or configured to execute or carry out the method for warning at least one road user within a parking facility which includes a monitoring system.

According to an example embodiment, the method according to the present invention is executed or carried out with the aid of the system according to the present invention.

Technical functionalities of the system result analogously from corresponding functionalities of the method and vice versa. Thus, this means, in particular, that method features result analogously from corresponding system features and vice versa.

The present invention is explained in greater detail below with reference to preferred exemplary embodiments and to the figures, in which identical reference numerals may be used for identical features.

DETAILED DESCRIPTION

Figure 1:
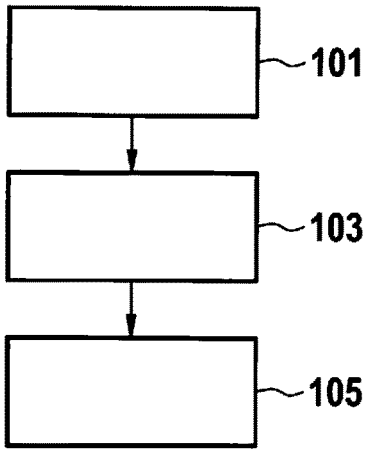
FIG. 1 is a flowchart of a method for warning at least one road user located within a parking facility, which includes a monitoring system, according to an example embodiment of the present invention.

FIG. 1 is a flowchart of a method for warning at least one road user located within a parking facility that includes a monitoring system. The method includes: monitoring 101 the parking facility with the aid of the monitoring system; ascertaining 103, based on the monitoring, whether the road user is to be warned of a hazard present within the parking facility; and warning (105) the road user if the ascertainment has indicated that the road user is to be warned of a hazard.

Figure 2:
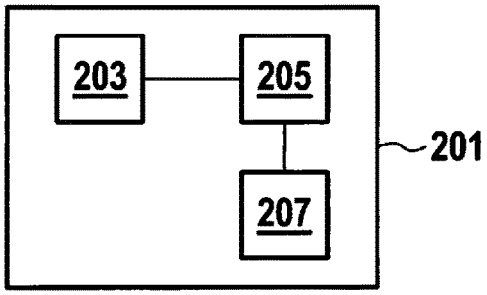
FIG. 2 shows a system for warning at least one road user located within a parking facility, according to an example embodiment of the present invention.

FIG. 2 shows a system 201 for warning at least one road user located within a parking facility. System 201 includes: a monitoring system 203 for monitoring the parking facility; a processing unit 205 for ascertaining, based on the monitoring, whether the road user is to be warned of a hazard present within the parking facility; and a warning system 207 for warning the road user, if the ascertainment has indicated that the road user is to be warned of a hazard.

Processing unit 205 includes, for example, one or multiple processors.

Figure 3:
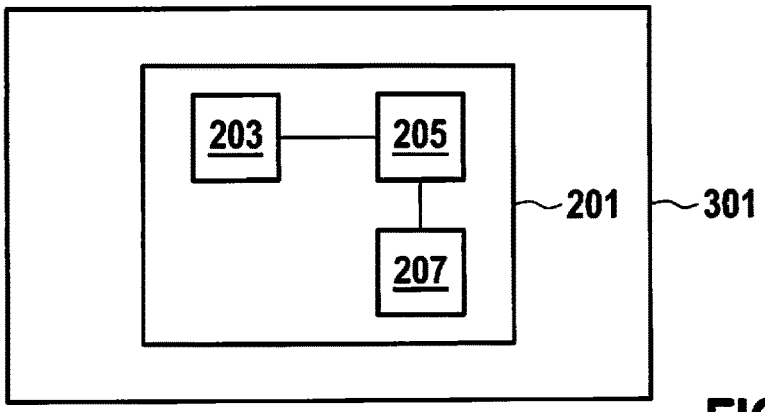
FIG. 3 shows a first parking facility, according to an example embodiment of the present invention.

FIG. 3 shows a first parking facility 301. Parking facility 301 includes system 201 of FIG. 2.

Figure 4:
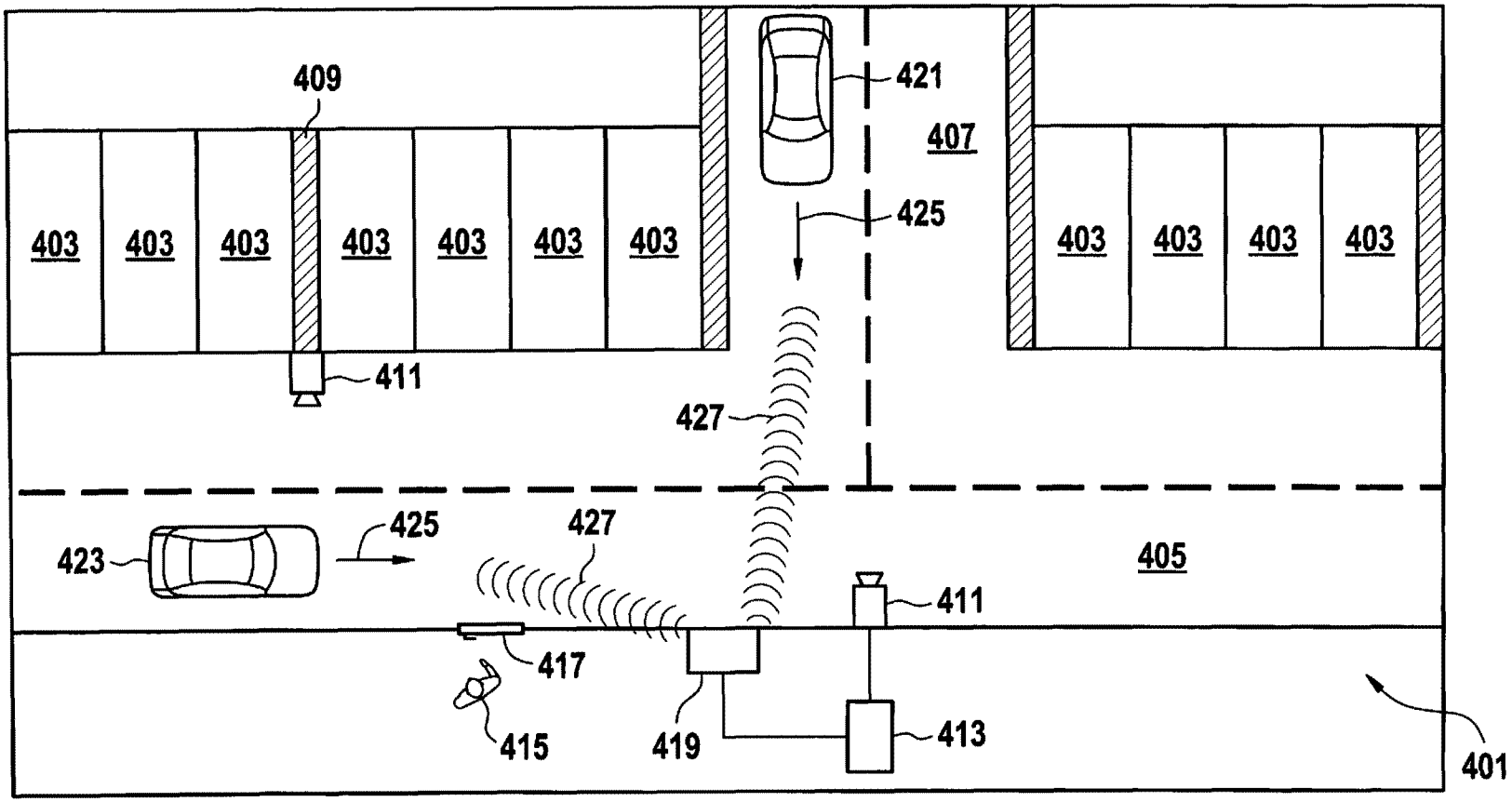
FIG. 4 shows a second parking facility according to an example embodiment of the present invention.

FIG. 4 shows a second parking facility 401. Parking facility 401 includes multiple parking spaces 403 for motor vehicles. Parking spaces 403 are situated transversely to a first roadway 405. A second roadway 407 runs perpendicularly to roadway 405.

Parking facility 401 includes multiple video cameras 411, one video camera 411, for example, being situated on a wall 409 between two parking spaces 403. Video cameras 411, for example, detect or monitor first roadway 405.

The video data corresponding to the monitoring are provided to a processing unit 413. This processing unit 413 ascertains, based on these video data, whether a road user located within parking facility 401 must be warned of a hazard. Such a hazard, for example, is an automatically guided motor vehicle 423, which is traveling from left to right on first roadway 405 relative to the paper plane.

A person 415 is located within parking facility 401, person 415 intending to enter through a door 417 onto roadway 405. However, since motor vehicle 423 is moving from left to right, which is marked symbolically by an arrow with the reference numeral 425 and is still located in front of door 417, motor vehicle 423 may represent a hazard to person 415.

In this case, therefore, person 415 is warned of motor vehicle 423. For example, a communication interface 419 transmits a message via a wireless communication network, so that this message can be received by a mobile terminal, which is carried by person 415. It is provided, for example, that the mobile terminal outputs, for example, vibrates, an alarm in response to a receipt of such a message. This wireless communication by communication interface 419 is represented symbolically by arcuate elements having reference numeral 427.

Another motor vehicle 421 is traveling on second roadway 407 in the direction of first roadway 405. A travel direction of this motor vehicle 421 is also marked with an arrow having reference numeral 425.

This additional motor vehicle 421, as a road user located within the parking facility 401, is also warned of motor vehicle 423. Here, it is provided, in particular, that a message is sent via the wireless communication network to a main control unit of motor vehicle 421, which can be referred to as a head unit.

Figure 5:
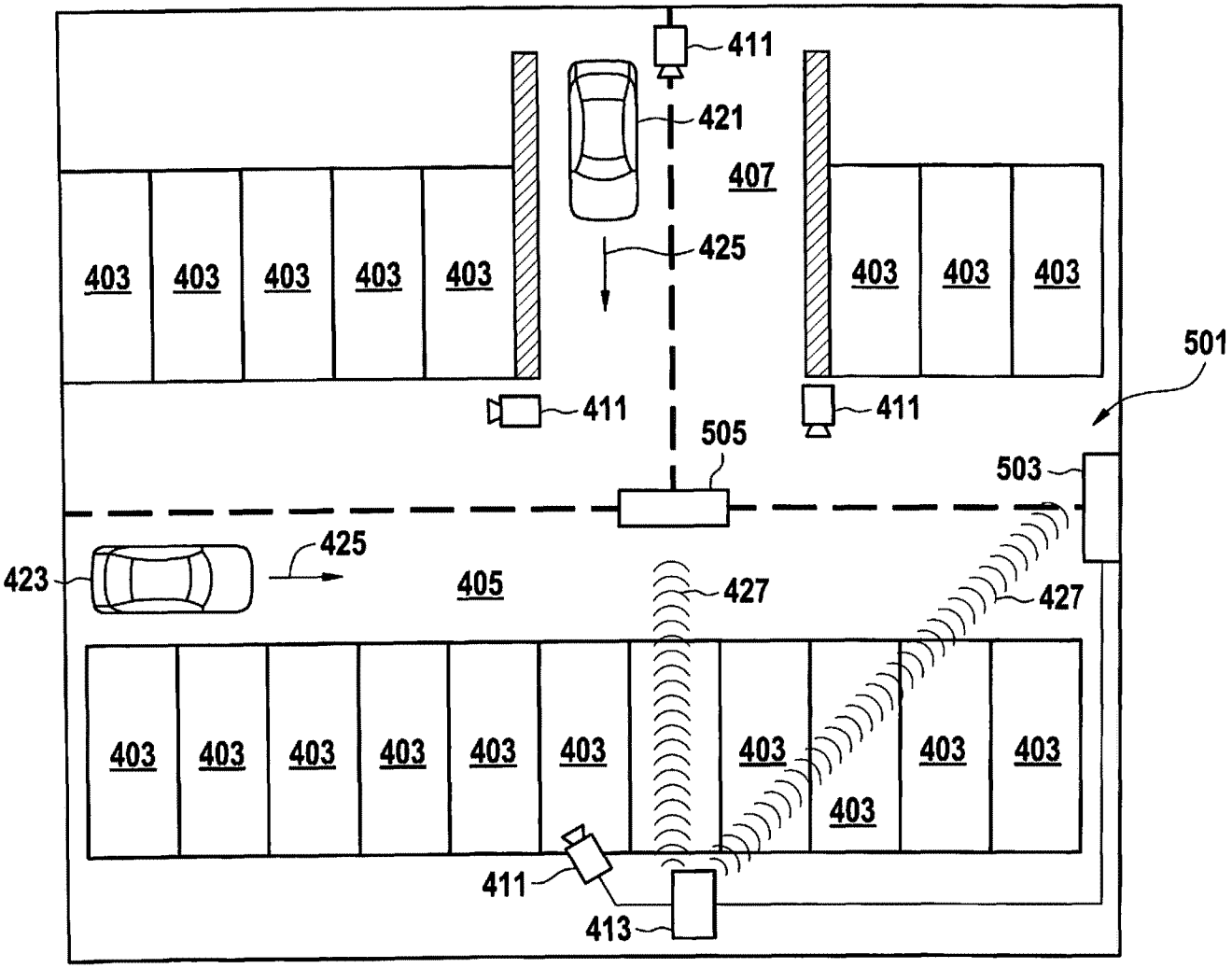
FIG. 5 shows a third parking facility according to an example embodiment of the present invention.

FIG. 5 shows a third parking facility 501. Third parking facility 501 also includes multiple video cameras 411, which monitor roadways 405, 407. The video data corresponding to the monitoring are also provided to processing unit 413.

Parking facility 501 includes two display devices 503, 505, which are situated spatially distributed within parking facility 501. Processing unit 413 communicates in a wired manner or wirelessly with display devices 503, 505. As in FIG. 4, a wireless communication is also represented here with the aid of arcuate elements having reference numeral 427.

As in FIG. 4, an automatically guided motor vehicle 423 is also traveling here on roadway 405 from left to right relative to the paper plane. Additional vehicle 421, traveling from top to bottom relative to the paper plane on second roadway 407 in the direction of first roadway 405, is warned of this hazard. This is effectuated according to this example embodiment by controlling display devices 503, 505 in such a way that they display a warning visually. For example, display devices 503, 505 display the text "stop."

In a normal situation, for example, i.e., if no warning of motor vehicle 423 is determined to be given, display devices 503, 505 can be used, for example, to display an advertisement.

Display devices 503, 505 are, for example, video projectors, screens, or symbol displays. Display devices 503, 505 can, for example, display the text "caution" as a warning.

A warning within the context of the present invention includes, for example, a text. The text includes, for example, that an automatically guided motor vehicle is coming from a particular direction, for example, from the left or from the right.

Examples of a warning within the context of the description include an audio signal, a vibration, and/or display of an image or a symbol, for example, a motor vehicle symbol, an exclamation point, a thunderbolt symbol, or a stop sign.

Real images of the situation and/or reprocessed images of the situation, for example, are displayed, i.e., provided as part of a warning. It is provided, for example, that a map of the parking facility from a bird's eye view, i.e., from above, is depicted, the positions and the movement directions of the individual objects located within the parking facility being plotted. Thus, these objects are, in particular, road users and the hazard. In an example, the images are displayed from a perspective of a road user.

The system according to an example embodiment of the present invention includes a parking facility administration system. The parking facility administration system, which can also be referred to as a parking facility management system, manages, i.e., operates, the parking facility. The parking facility administration system controls, for example, a traffic of automatically guided motor vehicles within the parking facility. For example, the parking facility administration system controls a motor vehicle remotely. For example, the parking facility administration system transmits a target position to a motor vehicle, which then drives autonomously to the target position.

Thus, the present invention is based, in particular, and among other things, on the concept of warning road users located within a parking facility of a hazard, in particular, of warning of an automatically guided motor vehicle. An automatically guided motor vehicle can be referred to, for example, as an AVP motor vehicle. "AVP" in this case stands for "Automated Valet Parking," which can be translated, in particular, as "automatic parking operation."

Thus, one basic idea of the present invention is automatically monitoring guided motor vehicles with the aid of the monitoring system, with additional road users being monitored using the monitoring system. This means, therefore, that the parking facility is monitored with the aid of the monitoring system. Based on the monitoring, it is analyzed whether road users should be warned of an automatically guided motor vehicle. Accordingly, a road user is then warned, i.e., informed of the hazard, depending on the situation.

Thus, the warning or the information, for example, is that motor vehicles automatically guided within the parking facility are presently on the move. This yields, for example, a technical advantage that the road user can efficiently adjust to this situation.

For example, a pedestrian is warned of an automatically guided motor vehicle, which will pass directly in front of a door, through which the pedestrian wishes to access a roadway on which the motor vehicle is traveling.

The road user is warned, in particular, of an automatically guided motor vehicle, which is presently unparking or, for example, is traveling around a next corner, which is therefore beyond the field of vision of the road user.

Warnings include, for example, instructions to the road user to act.

Thus, the evaluation of the monitoring is, in particular, situation-related and takes into consideration, for example, a position of the road user or road users and/or a respective predicted movement direction of the road user or road users and/or a position of the automatically guided motor vehicle and/or an instantaneous driving task of the automatically guided motor vehicle.

It is provided, for example, that the warning, i.e., the information of the hazard, is sent directly to the road user. This direct sending includes, for example, a sending of a corresponding message to a mobile terminal via a wireless communication network, the mobile terminal being carried by the road user.

If the road user is another motor vehicle, a corresponding message is sent to the head unit of the motor vehicle, for example.

A mobile terminal within the context of the description, for example, is a cell phone, a tablet, a smartwatch, data goggles, which can also be referred to as smart glasses, so-called "wearables," networked clothing, and/or networked implants.

The communication in this case is carried out, for example, wirelessly, for example, via WLAN and/or GSM.

The warnings or instructions in this case can be provided or displayed, for example, by at least one or multiple of the following options: as text, for example, "AVP coming from the left"; as an audio signal; as a vibration; as images; as symbols, for example, as a motor vehicle symbol, as an exclamation point, as a thunderbolt symbol, and/or as a stop sign; as real images of the situation; and/or as reprocessed images of the situation, for example, as a map from above including plotted positions and movement directions of the hazard and of the total number of road users, e.g., where the images are from the perspective of the road user.

What is claimed is:

1. A method for warning at least one road user located within a parking facility that includes a monitoring system, the method comprising:

monitoring the parking facility using the monitoring system;

ascertaining, based on the monitoring, whether the road user is to be warned of a hazard present within the parking facility; and warning the road user if the ascertainment has indicated that the road user is to be warned of the hazard;

wherein, the hazard is an automatically guided motor vehicle, the ascertainment includes a prediction of a movement of the motor vehicle and an ascertainment of whether the predicted movement results in a collision with the road user, and the road user is warned responsive to the predicted movement resulting in a collision with the road user, and wherein the road user is a person.

2. The method of claim 1, wherein the warning includes providing an instruction of how the road user is to behave to reduce a threat by the hazard to the road user.

3. The method of claim 1, wherein the ascertainment includes predicting a movement of the road user and an ascertainment of whether the predicted movement causing an entering into a hazard zone of the hazard, the road user being warned responsive to the predicted movement causing the entering into the hazard zone.

4. The method of claim 1, wherein a position of the road user is determined, the ascertainment being carried out based on the determined position of the road user.

5. The method of claim 1, wherein the hazard is an automatically guided motor vehicle, a position of the motor vehicle is determined, and the ascertainment is carried out based on the position of the motor vehicle.

6. The method of claim 1, wherein, the hazard is an automatically guided motor vehicle, which driving task the motor vehicle is instantaneously carrying out is ascertained, and the ascertainment of whether the road user is to be warned is carried out based on the instantaneous driving task of the motor vehicle.

7. The method of claim 1, wherein the warning includes sending a message via a wireless communication network to a mobile terminal carried by the road user.

8. The method of claim 1, wherein, the road user is a motor vehicle and the warning includes sending a message via a wireless communication network to a main control unit of the motor vehicle.

9. The method of claim 1, wherein the warning is displayed on a display device situated within the parking facility.

10. The method of claim 1, wherein the warning includes a visual provision of a real image of the hazard.

11. The method of claim 1, wherein the warning includes a visual provision of an abstract image of the hazard.

12. The method of claim 1, wherein the warning includes a visual provision of a digital map of a partial area or of an entire area of the parking facility, the hazard and the road user being represented in the digital map.

13. The method of claim 1, wherein a movement direction of the hazard is indicated in the digital map.

14. The method of claim 1, wherein a movement direction of the road user is indicated in the digital map.

15. The method of claim 1, wherein the warning includes a provision of a real image from a perspective of the road user.

16. A system for warning at least one road user located within a parking facility, comprising:

a sensor system;

a warning system; and a processing unit, wherein the processing unit is configured to perform the following:

ascertaining, based on results of monitoring of the parking facility by the sensor system, whether the road user is to be warned of a hazard present within the parking facility; and issuing, responsive to a result of the ascertainment being that the road user is to be warned, a warning of the hazard using the warning system;

wherein, the hazard is an automatically guided motor vehicle, the ascertainment includes a prediction of a movement of the motor vehicle and an ascertainment of whether the predicted movement results in a collision with the road user, and the road user is warned responsive to the predicted movement resulting in a collision with the road user, and wherein the road user is a person.

17. A parking facility, comprising:

a system for warning at least one road user located within a parking facility, the system including:

a sensor system;

a warning system; and a processing unit, wherein the processing unit is configured to perform the following:

ascertaining, based on results of monitoring of the parking facility by the sensor system, whether the road user is to be warned of a hazard present within the parking facility; and issuing, responsive to a result of the ascertainment being that the road user is to be warned, a warning of the hazard using the warning system, wherein, the hazard is an automatically guided motor vehicle, the ascertainment includes a prediction of a movement of the motor vehicle and an ascertainment of whether the predicted movement results in a collision with the road user, and the road user is warned responsive to the predicted movement resulting in a collision with the road user, and wherein the road user is a person.

18. A non-transitory computer-readable having a computer program, which is executable by a processor, comprising:

a program code arrangement having program code for warning at least one road user located within a parking facility that includes a monitoring system, by performing the following:

monitoring the parking facility using the monitoring system;

ascertaining, based on the monitoring, whether the road user is to be warned of a hazard present within the parking facility; and warning the road user if the ascertainment has indicated that the road user is to be warned of the hazard;

wherein, the hazard is an automatically guided motor vehicle, the ascertainment includes a prediction of a movement of the motor vehicle and an ascertainment of whether the predicted movement results in a collision with the road user, and the road user is warned responsive to the predicted movement resulting in a collision with the road user, and wherein the road user is a person.

* * * * *